US009790021B2

(12) United States Patent
Matos Rodriguez

(10) Patent No.: US 9,790,021 B2
(45) Date of Patent: Oct. 17, 2017

(54) DETACHABLE CONTAINER FOR STRAWBERRIES

(71) Applicant: Donana 1998, S.L., Almonte (ES)

(72) Inventor: Manuel Matos Rodriguez, Almonte (ES)

(73) Assignee: Donana 1998, S.L. (ES)

( * ) Notice: Subject to any disclaimer, the term of this patent is extended or adjusted under 35 U.S.C. 154(b) by 0 days.

(21) Appl. No.: 15/018,947

(22) Filed: Feb. 9, 2016

(65) Prior Publication Data

US 2017/0036852 A1 Feb. 9, 2017

(30) Foreign Application Priority Data

Aug. 7, 2015 (EP) ..... 15382420

(51) Int. Cl.

| | |
|---|---|
| ***B65D 85/34*** | (2006.01) |
| ***B65D 1/36*** | (2006.01) |
| ***B65D 25/10*** | (2006.01) |
| ***B65D 25/28*** | (2006.01) |
| ***B65D 43/02*** | (2006.01) |

(52) U.S. Cl.

CPC ..... *B65D 85/34* (2013.01); *B65D 1/36* (2013.01); *B65D 25/10* (2013.01); *B65D 25/28* (2013.01); *B65D 43/02* (2013.01); *B65D 2525/283* (2013.01)

(58) Field of Classification Search

CPC ..... B65D 1/34; B65D 1/36; B65D 21/0204; B65D 25/10; B65D 25/28; B65D 43/02; B65D 81/34; B65D 81/36; B65D 85/34; B65D 2525/283; B65D 21/02; A47G 23/06

USPC ..... 206/557–565; 220/23.2–23.86, 23.88; 426/106–127

See application file for complete search history.

(56) References Cited

U.S. PATENT DOCUMENTS 2,419,229 A * 4/1947 Preis ..... A47G 23/06 220/23.83
3,384,260 A * 5/1968 Buffington ..... A47G 23/06 206/558

(Continued)

FOREIGN PATENT DOCUMENTS

CN 203727927 U 7/2014
JP 2002234520 A 8/2002

(Continued)

*Primary Examiner* — Bryon Gehman
(74) *Attorney, Agent, or Firm* — Hayes Soloway PC

(57) ABSTRACT

Detachable container for strawberries which allows the transport, storage, presentation and consumption of the fruit in optimum conditions and with minimum handling from harvesting until consumption, formed by the joining through fitting by pressure between triangular cross-sectional-shaped cavities and protuberances of a base and a lid respectively, the base having cells to house the individual pieces of fruit. The number and the size of cells depend on the characteristics of the strawberries that they must contain. The container may be separated into up to four sub-units by simple pulling along diagonal tear lines, and it has retracting handles on its sides to facilitate its transport, as well as a central orifice to thread the containers on a vertical rod in the point-of-sale and obtain a more attractive presentation.

8 Claims, 7 Drawing Sheets

(56) References Cited

U.S. PATENT DOCUMENTS

| | | | | | |
|---|---|---|---|---|---|
| 3,520,439 | A * | 7/1970 | Smith | B65D 1/30 | 220/23.4 |
| 4,886,179 | A * | 12/1989 | Volk | B65D 21/0204 | 220/23.4 |
| 6,382,452 | B1 * | 5/2002 | Getachew | B65D 21/0204 | 220/23.4 |
| 6,767,608 | B1 | 7/2004 | Salvaggio | | |
| 8,210,355 | B2 * | 7/2012 | Lee | C23C 14/50 | 206/558 |
| 8,778,430 | B2 * | 7/2014 | Dietrich | B65B 5/06 | 426/110 |
| 2016/0316945 | A1 * | 11/2016 | Sarantis | A47G 19/03 | |

FOREIGN PATENT DOCUMENTS

| | | | |
|---|---|---|---|
| JP | 2010168083 | A | 8/2010 |
| KR | 20140114587 | A | 9/2014 |

* cited by examiner

DETACHABLE CONTAINER FOR STRAWBERRIES

OBJECT OF THE INVENTION

The present invention is included within the technical field of receptacles for the storage and transport of objects, more specifically those especially adapted for fruit, and it has the object of a detachable container to transport and store strawberries, also serving to consume them outside of the domestic environment.

BACKGROUND OF THE INVENTION

Various types of packaging are known in the state of the art for fruit, determining factors of the most appropriate for each given case being the maintenance of optimum physiological conditions of the product, extending its storage, and the suitable presentation to make it attractive to the consumer, always bearing in mind that it must be avoided that the container factor considerably increases the end price of the product.

Different groups can be made within said containers, such as, for example, among those for transport and bulk sale, within which would be the well-known corrugated cardboard or wooden boxes, those for retail sale, such as trays, bags and sacks, generally of plastic material, and those designed for products that require special storage conditions such as multi-layered bags of selective permeability for vacuum-packaging and storage at low temperatures.

Within said groups of containers, the most suitable for high added value products, i.e. those sought out by gourmet-type consumers, are those of retail sale such as moulded pulp or polystyrene tray, plastic bags or mesh bags.

Said type of consumers increasingly value the appropriate presentation and quality of the end product, there also being a trend to look for products which have undergone minimal handling from their harvesting in the field to their acquisition by the end user at the point-of-sale.

The current containers do not offer the possibility of an individualized treatment of the pieces of fruit, giving rise to rubbing between them which will cause deteriorations, nor do they allow optimum refrigeration, nor a good presentation, nor the creation of a modified microclimate which guarantees the suitable conditions for storage of the fruit.

DESCRIPTION OF THE INVENTION

The claimed container of the invention makes it possible to transport, store, show and consume high-quality strawberries with very little intermediate handling of the product from the time it is harvested in the field until when the container is opened and the product is consumed by the end buyer, maintaining at all times, optimum storage conditions and allowing an attractive presentation. Each strawberry receives individualized treatment, without them being contacted and rubbing between them which negatively affects their quality.

Therefore, the container, made in any of the plastic materials approved for its food use, is composed of two pieces of essentially quadrangular form and of similar measurements: a lower base which contains the compartments which will accommodate each strawberry, and an upper lid which serves to protect them and maintain the adequate internal conditions; both elements being joined by means of supports with a triangular cross-sectional shape so that a container is obtained which behaves as a block once said join occurs.

The lower base has alveolar-shaped recesses on its surface which will form the compartments wherein the pieces of strawberry will be housed after their first wash on being received in the handling plant, said cavities being adapted to the forms and measurements of different types of strawberries. Said cells are distributed on the surface of the lower tray with different layouts in accordance with the size of the strawberry they must house. In an example of embodiment, the cells are in a triangular-shaped layout, whilst in the others they are in array or diagonal form. In all cases, as the cells are sufficiently separated from one another, there is no possibility of contact between the strawberries once they are introduced in the tray. The cells have perforations in their base which allow an homogeneous refrigeration since they guarantee the arrival of the cooling fluid to all pieces.

Cavities have also been provided in the lower tray, in this case being triangular cross-sectional shaped, designed to receive protuberances protruding from the lid also with a triangular cross-sectional shape, but with slightly greater dimensions, disposed on the tray surface, preferably in the corners and in the side part of its main diagonals, thus performing the closure of the container by pressure between both pieces.

This difference of measurements between supports allows the stacking of the containers without pressure or damage to the fruit contained in it occurring and guaranteeing a simple join between both pieces, applying minimum pressure which prevents them from separating and that the strawberries moving inside it, maintaining the atmosphere in which the product is packaged, which will be optimum for its storage until the time of opening for its consumption.

In terms of the upper lid, which must be of transparent plastic material to allow the visual inspection of the product contained, it has the aforementioned triangular cross-sectional-shaped protuberances, disposed so that they fit in with the triangular cross-sectional-shaped cavities of the lower tray to be able to close the unit, and also with folding handles made on the same side and disposed on each one of the external side edges of the lid, to facilitate transport.

Once the join is made between both pieces by means of the fitting by pressure between aforementioned triangular cross-sectional-shaped protuberance and cavities, a single closed cubic block is formed which can be easily separated by hand into up to four individual triangular pieces by pulling on diagonal tear lines made both in the upper and lower part, also allowing the transport and consumption of the strawberries outside of the domestic environment. Furthermore, each one of the individualized parts can be easily carried thanks to the folding handles of the lid sides.

Both the base and the lid have an orifice in their geometric centre, so that the closed containers may be disposed vertically threaded on a metal rod in the point-of-sale, being stacked by way of a tower and showing an attractive presentation to the consumer.

In a preferred embodiment, the container has standard measurements of 23×23×6 centimeters, although it can be made in any other measurements, which makes it possible to contain 250 grams of the product. Said measurements allow its packaging in boxes of standard dimension and its later palletization in Euro-pallets, facilitating the transport.

DESCRIPTION OF THE DRAWINGS

To complement the description being made and in order to aid towards a better understanding of the characteristics of the invention, in accordance with a preferred example of practical embodiment thereof, a set of drawings is attached as an integral part of said description wherein, with illustrative and non-limiting character, the following has been represented.

PREFERRED EMBODIMENT OF THE INVENTION

Below, and with the aid of the previous drawings and their numerical references, an example of preferred embodiment of the invention is described.

The detachable container for strawberries, which allows their transport, storage, presentation and consumption, is formed by the joining of a lower base (1) with an upper lid (2), both being essentially square and in both parts being made of plastic of the group of those considered suitable for their use in the food industry, considering that the plastic material used for the manufacturing of the lid (2) must be transparent to allow the display of the product contained, both by the end consumer and by the intermediate quality control inspections.

Figure 1:
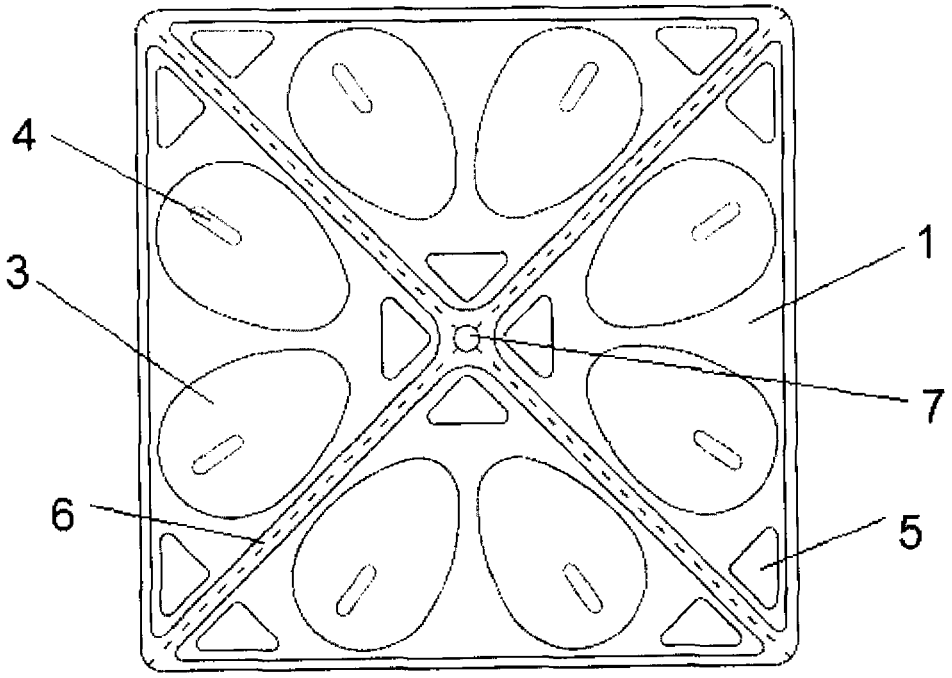
FIG. 1.—Shows a plan view of the container base.
Figure 2:
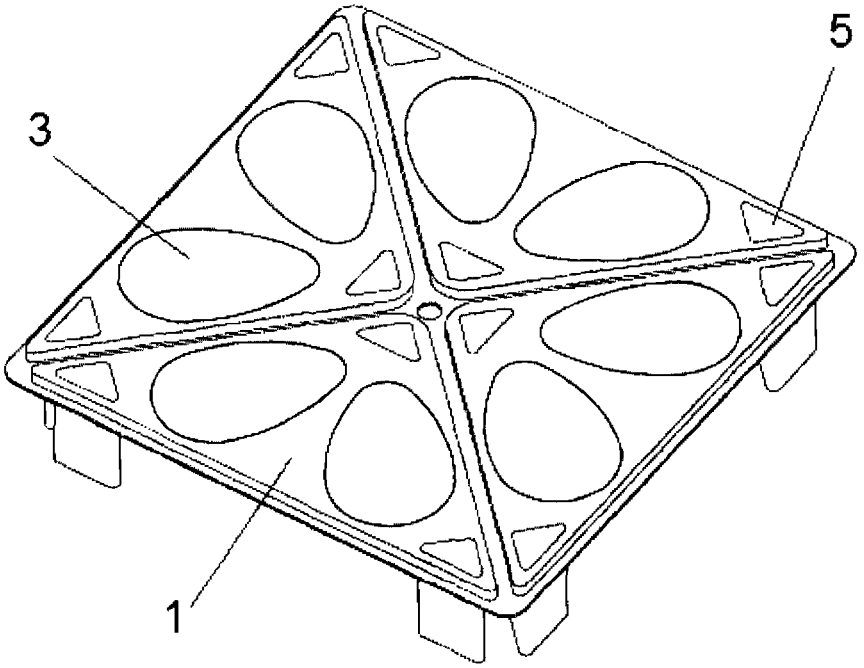
FIG. 2.—Shows a top perspective view of the container base.
Figure 7:
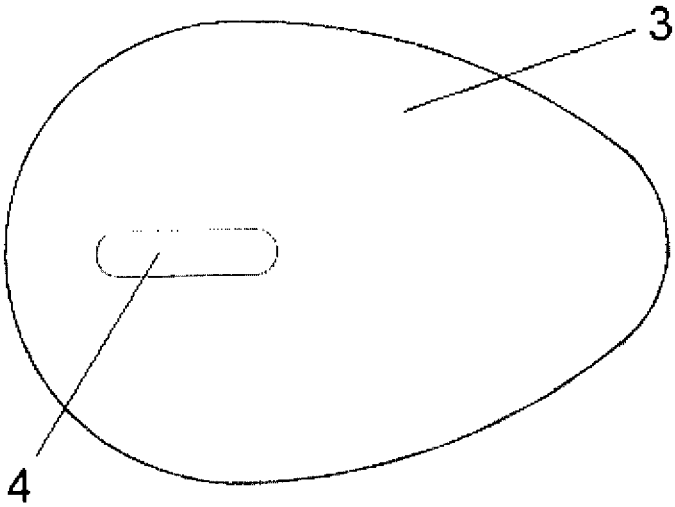
FIG. 7.—Shows a plan view of a reception cell for a piece of strawberry.
Figure 8:
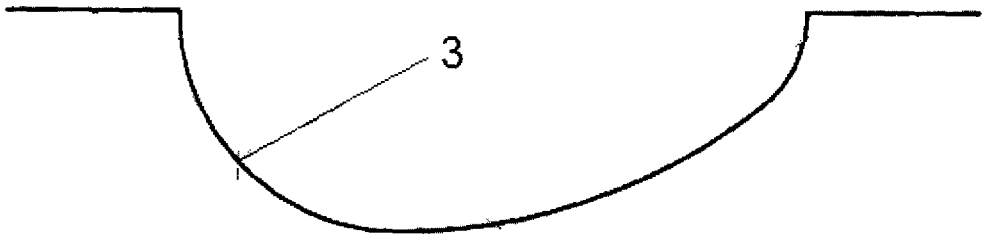
FIG. 8.—Shows a profile view of a reception cell for a piece of strawberry.
Figure 9:
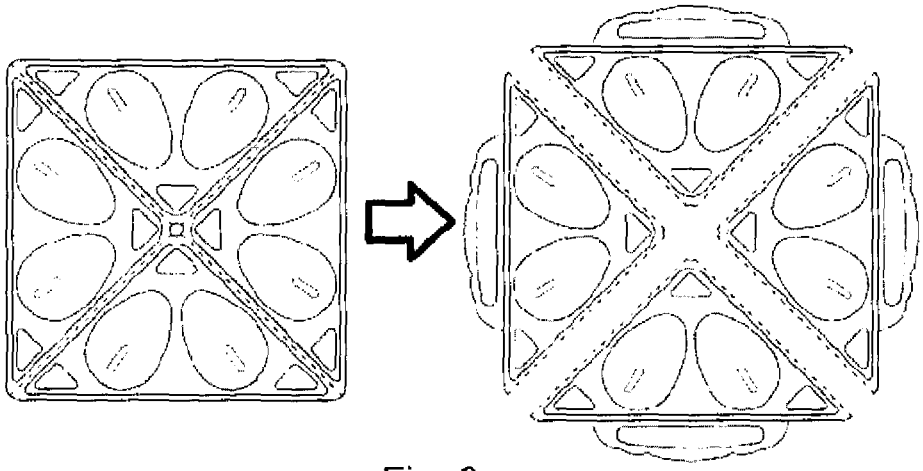
FIG. 9.—Shows a plan view of the separation sequence of the base in 4 individual sub-pieces through the diagonal tear lines.
Figure 10:
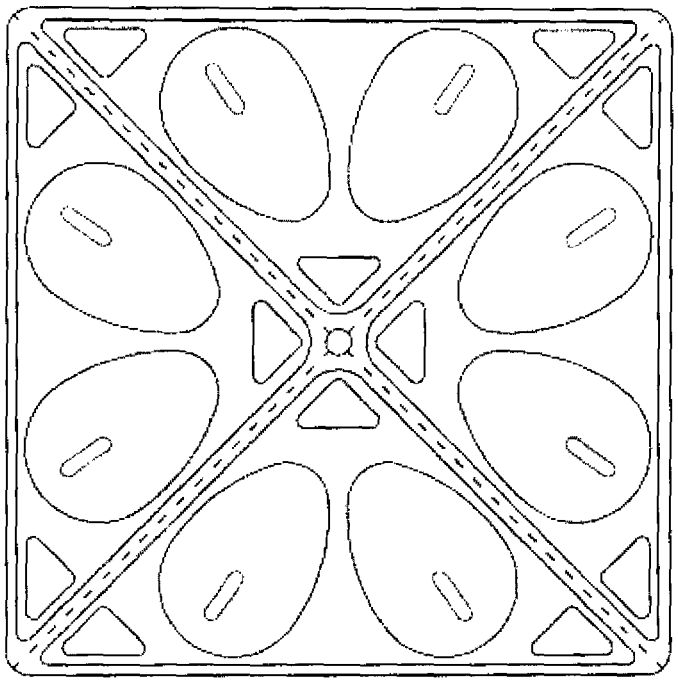
FIG. 10.—Shows the plan view of the layout of the cells in the base, to accommodate 8 large-sized strawberries.
Figure 11:
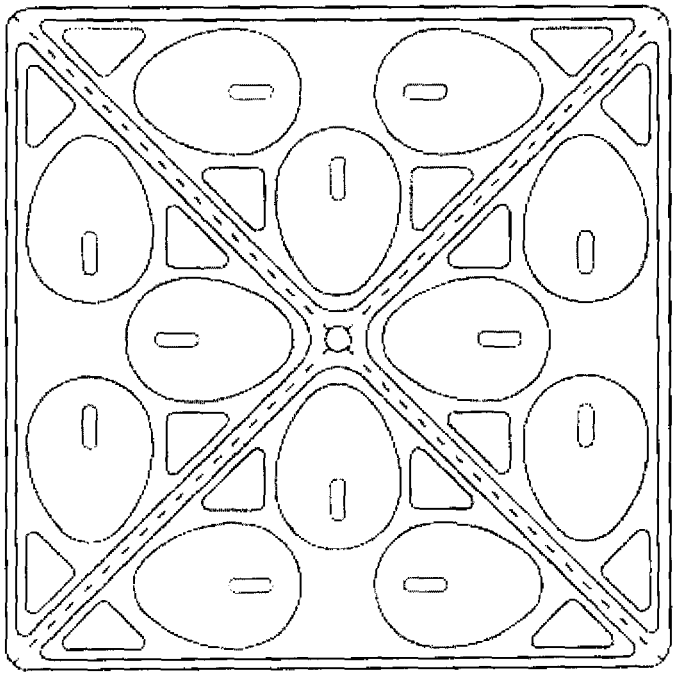
FIG. 11.—Shows the plan view of the layout of the cells in the base, to accommodate 12 medium-sized strawberries.
Figure 12:
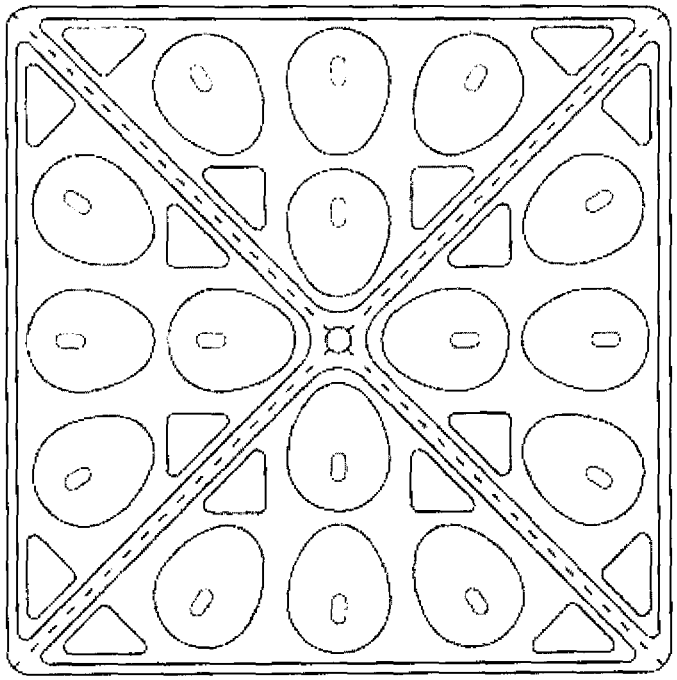
FIG. 12.—Shows the plan view of the layout of the cells in the base, to accommodate 16 small-sized strawberries.

The lower base (1) shown in FIGS. 1 and 2 has cavities or alveolar-shaped recesses (3) on its surface which will form the compartments wherein the individual pieces of strawberry will be housed after washing operations prior to its packaging, with different forms and measurements of said cells (3) being provided to adapt to the characteristics and dimensions of different types of strawberries. The measurements of the fruit shall condition the number of cells (3) which can be made on the surface of the lower base (1), giving rise to different layouts, as shown in FIGS. 9 to 11, always considering that there is no possibility of contact between the strawberries once they are placed in their respective housings. The cells (3) have perforations (4) in their base as can be seen in detail in FIG. 7, with the aim of guaranteeing homogeneous refrigeration, since it allows the action of the cooling fluid on all the pieces.

The base (1) or lower tray also has triangular cross-sectional-shaped cavities (5), of certain measurements, distributed on its surface, preferably in the areas close to the corners and also on both sides of the central part of tear lines (6) made diagonally on its surface. It also has an orifice (7) in its geometric centre.

Figure 3:
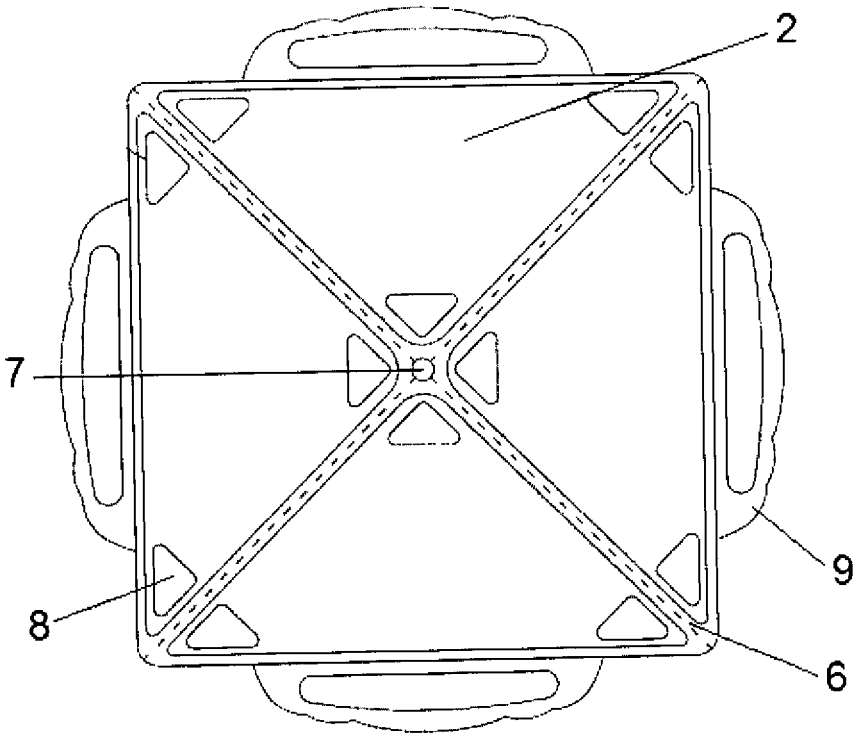
FIG. 3.—Shows a plan view of the container lid.
Figure 4:
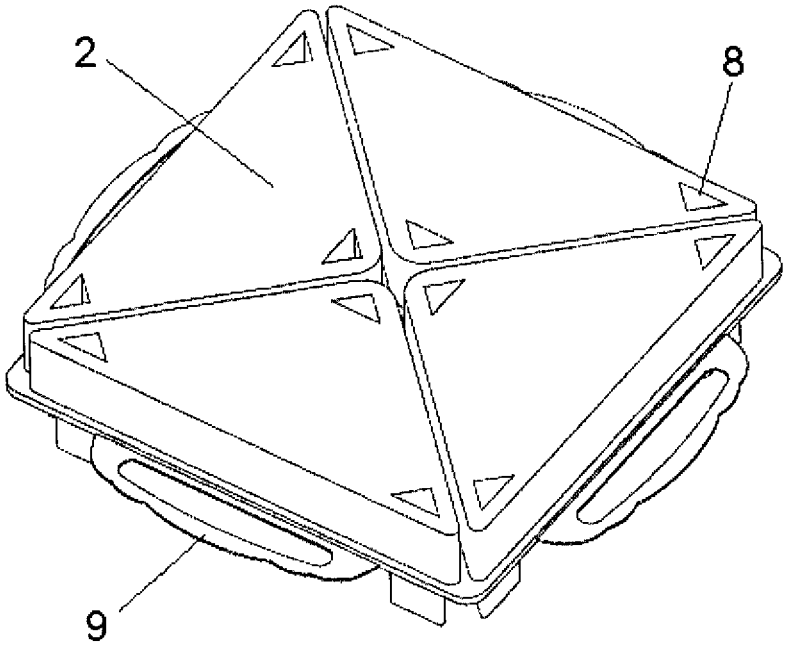
FIG. 4.—Shows a top perspective view of the container lid.
Figure 5:
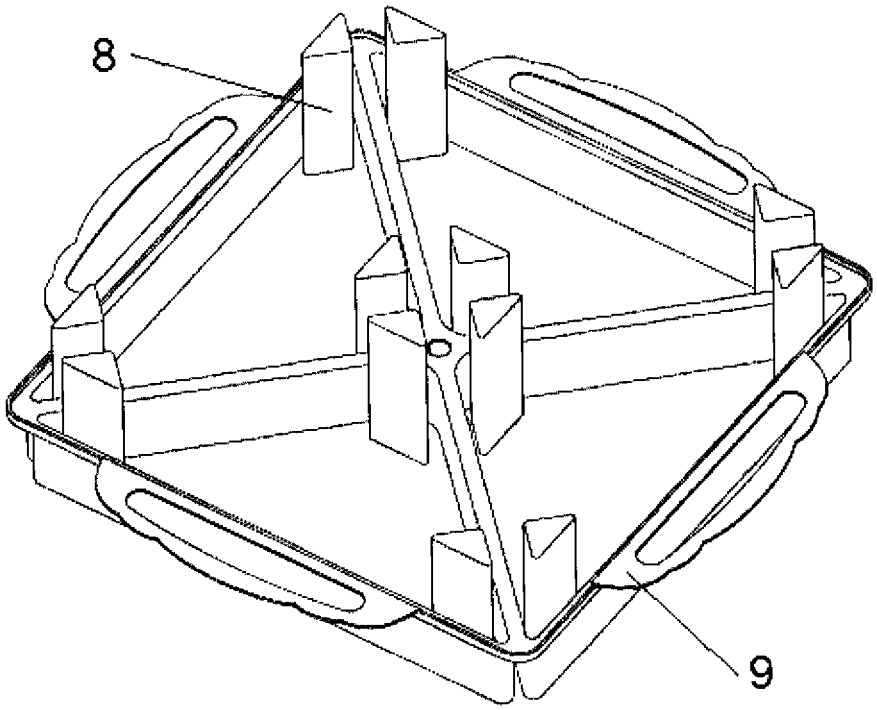
FIG. 5.—Shows a bottom perspective view of the container lid.

The upper lid (2), shown in FIGS. 3, 4 and 5, has triangular cross-sectional-shaped protuberances (8) projected towards its lower surface, disposed so that they fit with the cavities (5) of the base (1), with said protuberances (8) having measurements slightly greater than those of the corresponding cavity (5) of the lower part, so that both pieces are joined by application of a slight pressure which prevents the pieces from separating and avoids that the strawberries housed in the cells (3) of the lower base (1) move once the assembly is closed, also guaranteeing maintaining the atmosphere in which the product is packaged, which will be optimum for its storage up to the time of opening for its consumption.

Figure 6:
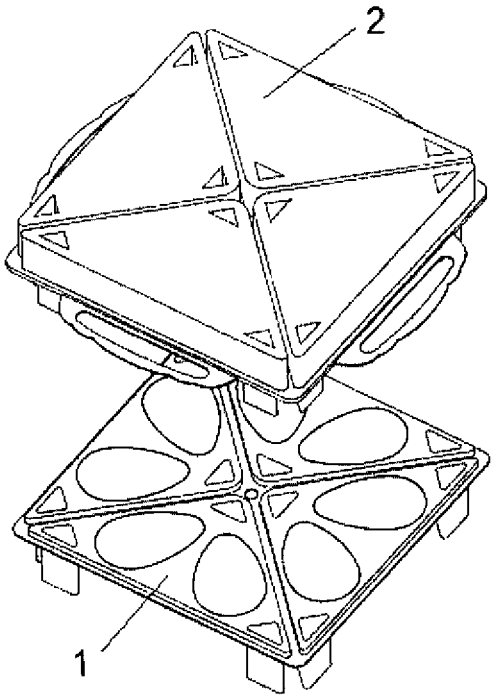
FIG. 6.—Shows a perspective view of the joining sequence of the lid with the base to configure the container.

Said upper lid (2) also has diagonal tear lines (6) on its surface, which coincide with the tear lines of the lower tray (1) when both pieces are vertically joined, as observed in FIG. 6, to be able to separate, if desired, the container into up to four individual sub-containers, which are smaller and essentially triangular, simply by pulling along said tear lines (6), as seen in the sequence represented in FIG. 9. It also has a central orifice (7), also coinciding with that of the lower tray on performing the assembly, to give the possibility of display in the point-of-sale of the containers with the product contained threaded on a rod through said orifice (7), thus achieving a more novel and attractive presentation for the consumer.

Finally, there are also folding handles (9) made in the same material and disposed on each one of the external side edges of the lid (2), to facilitate the transport of both the container and its separated pieces.

The invention claimed is:

1. Detachable container for strawberries, which allows their transport, storage, presentation and consumption, comprising a base and a lid, both of substantially quadrangular form and with similar measurements, with the surface of said base having cells, which will form compartments wherein individual pieces of strawberry will be housed, said cells having perforations to ensure a homogeneous refrigeration of the strawberries contained, and triangular cross-sectional-shaped cavities, and with the lid having triangular cross-sectional-shaped protuberances disposed so that they vertically coincide with the triangular cross-sectional-shaped cavities of the base, forming the container by the joining of the base and the lid through fitting by simple pressure of the triangular cross-sectional-shaped protuberances protruding from the lid in the triangular cross-sectional-shaped cavities of the base, guaranteeing the fitting by the difference of measurements between protuberances and cavities, with that of the protuberances being slightly greater than that of the cavities.

2. The detachable container for strawberries of claim 1, wherein both its base and its lid have broken diagonal lines, coinciding with one another on assembling both parts to obtain a final container, which allow the separation of the container into up to four individual containers in substantially triangular shape by pulling along the broken diagonal lines.

3. The detachable container for strawberries of claim 2, wherein the lid has external side edges on which folding handles made in the same material as the lid are disposed to facilitate the transport of both the container and the four individual containers in substantially triangular shape wherein the container can be divided.

4. The detachable container for strawberries of claim 1, wherein both the base and the lid have an orifice in their geometric centre, coinciding on assembling both parts to obtain a final container, which allow vertically stacking the containers in a point-of-sale by threading the base and the lid on a rod through said orifice.

5. The detachable container for strawberries of claim 1, wherein the container has quadrangular form with dimensions of 23 centimeters on its side and 6 centimeters in height to contain up to 250 grams of product.

6. The detachable container for strawberries of claim 1, wherein the base has eight large cells disposed along a plurality of secondary diagonals of the surface to accommodate eight large pieces of strawberries.

7. The detachable container for strawberries of claim 1, wherein the base has twelve medium cells disposed in triangular form on the surface to accommodate twelve pieces of medium-sized strawberries.

8. The detachable container for strawberries of claim 1, wherein the base has sixteen small cells disposed in triangular form on the surface to accommodate sixteen pieces of small-sized strawberries.

* * * * *